US005141543A

United States Patent [19]

Agrawal et al.

[11] Patent Number: 5,141,543

[45] Date of Patent: * Aug. 25, 1992

[54] USE OF LIQUEFIED NATURAL GAS (LNG) COUPLED WITH A COLD EXPANDER TO PRODUCE LIQUID NITROGEN

[75] Inventors: Rakesh Agrawal; Thomas E. Cormier, Sr., both of Allentown, Pa.

[73] Assignee: Air Products and Chemicals, Inc., Allentown, Pa.

[ * ] Notice: The portion of the term of this patent subsequent to Aug. 11, 2009 has been disclaimed.

[21] Appl. No.: 691,773

[22] Filed: Apr. 26, 1991

[51] Int. Cl.[5] ..... F25J 1/00; F25J 1/02

[52] U.S. Cl. ..... 62/8; 62/9; 62/40

[58] Field of Search ..... 62/8, 9, 40, 13, 24, 62/30

[56] References Cited

U.S. PATENT DOCUMENTS

| | | | |
|---|---|---|---|
| 3.857.251 | 12/1974 | Alleaume | 62/28 |
| 3.886.758 | 6/1975 | Perrotin et al. | 62/30 |
| 4.054.433 | 10/1977 | Buffiere | 62/13 |
| 4.192.662 | 3/1980 | Ogata et al. | 62/13 |
| 4.211.544 | 7/1980 | Springmann | 62/40 X |
| 4.437.312 | 3/1984 | Newton et al. | 62/50.2 X |
| 4.582.519 | 4/1986 | Someya et al. | 62/9 X |
| 4.638.639 | 1/1987 | Marshall et al. | 62/9 |
| 4.894.076 | 1/1990 | Dobracki et al. | 62/9 |

FOREIGN PATENT DOCUMENTS

| | | |
|---|---|---|
| 0304355 | 2/1989 | European Pat. Off. . |
| 2307004 | 8/1974 | Fed. Rep. of Germany . |
| 46-20123 | 6/1971 | Japan . |
| 52-37596 | 3/1977 | Japan . |
| 53-15993 | 5/1978 | Japan . |
| 58-150786 | 9/1983 | Japan . |
| 1376678 | 12/1974 | United Kingdom . |
| 1520581 | 8/1978 | United Kingdom . |

OTHER PUBLICATIONS

Yamanouchi et al., Chem. Engr. Progress, Jul. 1979.

*Primary Examiner*—Henry A. Bennet
*Assistant Examiner*—Christopher B. Kilner
*Attorney, Agent, or Firm*—Willard Jones, II; William F. Marsh; James C. Simmons

[57] ABSTRACT

The present invention relates to a process for the liquefaction of a nitrogen stream produced by separating air components, by using the combination of cryogenic distillation with improved refrigeration. Very cold liquefied natural gas (LNG) is employed as refrigerant, with the LNG currently being revaporized for transportation.

Multi-stage component compression is used, with the component feed to each compression stage being precooled using sequential refrigeration from the LNG. Expander means for the coldest air component product stream provides supplemental refrigeration at the cold end beyond that which is available from the refrigerant LNG.

In a preferred embodiment, the feed nitrogen stream(s) are compressed to at least 300 psi in a multi-stage compressor with interstage cooling provided by heat exchange against vaporizing LNG; the resulting compressed stream is directed into first and second nitrogen substreams, followed by further cooling of the first substream by heat exchange against vaporizing LNG and then expanding the cooled first substream to produce an expanded nitrogen substream. Condensing of the second compressed substream against both vaporizing LNG and the expanded nitrogen substream is carried out. Reducing the pressure of the condensed second nitrogen substream produces a two phase nitrogen stream. Phase separation yields a recyclable nitrogen vapor stream and a liquid nitrogen stream as product.

7 Claims, 4 Drawing Sheets

USE OF LIQUEFIED NATURAL GAS (LNG) COUPLED WITH A COLD EXPANDER TO PRODUCE LIQUID NITROGEN

TECHNICAL FIELD OF THE INVENTION

The present invention relates to a process for liquefaction of nitrogen produced by separating air by cryogenic distillation using an improved refrigeration source, particularly, vaporizing LNG, to yield the liquefied nitrogen.

BACKGROUND OF THE INVENTION

The separation of air to produce oxygen, nitrogen, argon, and other materials is done by distillation under low pressure to achieve power conservation. It is known that the refrigeration available from liquefied natural gas (LNG) can be utilized for cooling feed air and/or compressing component gases.

When pipelines are not feasible, natural gas is typically liquefied and shipped as a bulk liquid. At the receiving port, this liquefied natural gas (LNG) must be vaporized and heated to ambient temperatures. An efficient use of this refrigeration at the time of vaporization is highly desirable. It is becoming more common to build air separation plants with liquefiers which utilize the refrigeration available from the vaporizing LNG. An efficient scheme, which more effectively utilizes the refrigeration available from LNG to produce liquid products from air, can lead to substantial savings in energy and capital investment.

Liquefier processes are needed, especially for the case where the demand for liquid product is so high that the available amount of refrigerant LNG is unable to fully meet the total refrigeration demands. Generally, this situation occurs where the equivalent tons of liquid nitrogen produced per ton of LNG is greater than 0.45. In such instances, supplemental refrigeration from existing energy sources is needed to meet the extra refrigeration demand. While some solutions have been proposed, they do not involve any precooling of the gaseous component for liquefaction, prior to each cold compression stage, nor do they suggest using an expander means to produce liquid product, suited to provide supplemental refrigeration. The technical problem is to integrate the added refrigeration requirements with the primary one available from LNG and to do it at variable temperature levels.

Several publications disclose the production of liquid nitrogen by indirect heat exchange against vaporizing LNG. Since the coldest temperature of LNG is typically above −260° F., the nitrogen must be at a pressure greater than ambient pressure in order to be condensed because the normal boiling point of nitrogen is −320° F. Typically, to condense at temperatures of about −260° F., the nitrogen must be compressed to above 225 psia. Compression of the nitrogen prior to its condensation by heat exchange with LNG is one of the major sources of energy consumption in producing a liquid nitrogen product.

U.S. Pat. No. 3,886,758 discloses a method wherein a nitrogen stream is compressed to a pressure of about 15 atm (221 psia) and then condensed by heat exchange against vaporizing LNG. Since all the gaseous nitrogen is not precooled against the warming natural gas prior to compression, the amount of energy required for the nitrogen compressor is quite high.

U.K. patent application 1,520,581 discloses a process of using the excess refrigeration capacity associated with a natural gas liquefaction plant to produce additional LNG, specifically for the purpose of providing refrigeration for the liquefaction of nitrogen. In the process, the nitrogen gas from the air separation plant to be liquefied is compressed without any precooling with LNG.

Yamanouchi and Nagasawa (*Chemical Engineering Progress*, pp 78, Jul. 1979) describe another method of using LNG refrigeration for air separation. Once again, nitrogen at about 5.2 atm is compressed to about 31 atm without any precooling. Moreover, in this paper, LNG is vaporized in the LNG heat exchanger at close to ambient pressure (15 psia).

U.K. patent 1,376,678 teaches that evaporation of LNG at close to atmospheric pressure is inefficient because the vaporized natural gas must be admitted into a distribution pipeline at a pressure at which it can reach its destination, i.e., a transport pressure. This transport pressure is much higher than atmospheric pressure usually not exceeding 70 atm (1029 psi). Therefore, if LNG is vaporized at atmospheric pressure, then a considerable amount of energy is required to recompress the vaporized gas to its transport pressure. As a result, in U.K. patent 1,376,678, the LNG is first pumped to the desired pressure and then vaporized. Unfortunately, the process of refrigeration energy recovery taught in this patent is inefficient because not all of the refrigeration available from the LNG is recovered and the vaporized natural gas leaving the LNG heat exchanger is still quite cold (−165° F.). This incomplete recovery of refrigeration implies that, for this process, large quantities of LNG will be required to produce the desired quantity of liquid nitrogen.

Japanese patent publication 52-37596 (1977) teaches vaporizing low pressure LNG against an elevated pressure nitrogen stream, which is obtained directly from a distillation column which operates at an elevated pressure. In the process, only part of the LNG is vaporized against the condensing nitrogen and the remainder of the LNG is vaporized in the other heat exchangers; this is an inefficient use of the refrigeration energy of LNG. The vaporized natural gas is then compressed.

U.S. Pat. No. 3,857,251 discloses a process for producing liquid nitrogen by extraction of nitrogen from the vapors resulting from the evaporation of LNG in storage tanks. The gaseous nitrogen is compressed in a multistage compressor with interstage cooling provided by water, air, propane, ammonia, or fluorocarbons.

Japanese patent publication 46-20123 (1971) teaches cold compression of a nitrogen stream which has been cooled by vaporizing LNG. Only a single stage of nitrogen compression is used. As a result, an effective use of LNG cold energy, which vaporizes over a wide range of temperature, is not obtained.

Japanese patent publication 53-15993 (1978) teaches the use of LNG refrigeration for the high pressure nitrogen drawn off the high pressure column of a double column air distillation system. The nitrogen is cold compressed in a multistage compressor, but without any interstage cooling with LNG.

German patent 2,307,004 describes a method for recovering LNG refrigeration to produce liquid nitrogen. Nitrogen gas from the warm end of a cryogenic air separation plant is close to ambient pressure and ambient temperature. This feed nitrogen is compressed, without any LNG cooling, in a multistage compressor.

A portion of this compressed gas is partially cooled against LNG and expanded in an expander to create low level refrigeration. The other portion of compressed nitrogen is cold compressed and condensed by heat exchange against the expanded nitrogen stream. The expanded gas is warmed and recompressed to an intermediate pressure and then fed to the nitrogen feed compressor operating with an inlet temperature close to ambient. It is clear that most of the nitrogen compression duty is provided in compressors with inlet temperature close to ambient temperature and that no interstage cooling with LNG is provided in these compressors.

U.S. Pat. Nos. 4,054,433 and 4,192,662 teach methods whereby a closed loop, recirculating fluid is used to transfer refrigeration from the vaporizing LNG to a condensing nitrogen stream. In U.S. Pat. No. 4,054,433, a mixture of methane, nitrogen, ethane or ethylene and $C_3+$ is used to balance the cooling curves in the heat exchangers. The gaseous nitrogen from the high pressure column (pressure≃6.2 atm) is liquefied without any further compression. However, a large fraction of nitrogen is produced at close to ambient pressure from a conventional double column air distillation apparatus. Its efficient liquefaction would require a method to practically compress this nitrogen stream, which is not suggested in this U.S. patent.

In U.S. Pat. No. 4,192,662, fluorocarbons are used as recirculating fluid wherein it is cooled against a portion of the vaporizing LNG and then used to cool low to medium pressure nitrogen streams. This scheme presents some problems and/or inefficiencies. Energy losses due to fluorocarbon recirculation are large; requiring additional heat exchangers and a pump. Furthermore, the use of fluorocarbons has negative environmental implications and use of alternate fluids are expensive.

Japanese patent publication 58-150786 (1983) and European patent application 0304355-A1, (1989) teach the use of an inert gas recycle such as nitrogen or argon to transfer refrigeration from the LNG to an air separation unit. In this scheme, the high pressure inert stream is liquefied with natural gas, and then revaporized in a recycle heat exchanger to cool a lower pressure inert recycle stream from the air separation unit. This cooled lower temperature inert recycle stream is cold compressed and a portion of it is mixed with the warm vaporized high pressure nitrogen stream. The mixed stream is liquefied against LNG and fed to the air separation unit to provide the needed refrigeration and then returned from air separation unit as warm lower pressure recycle stream. Another portion of the cold compressed stream is liquefied with heat exchange against LNG and forms the stream to be vaporized in the recycle heat exchanger. These schemes are inefficient. For example, all of the recirculating fluids are cold compressed in a compressor with no interstage cooling with LNG.

Consequently, the previous process is considerably limited to the instances where each ton of liquid nitrogen produced per ton of LNG used is below 0.5, and preferably below 0.45. So there are still situations where the amount of nitrogen to be liquefied well exceeds the refrigeration available from LNG at the aforelisted cold temperature range (−180° F. to −260° F.). The present invention addresses this practical constraint by the teaching of a thermodynamically more effective process for nitrogen liquefaction.

As just noted, there is a growing need for a liquefaction system which more efficiently utilizes the cold energy of vaporizing LNG to produce liquid products from air with substantial economies. Also, there is a demand to be able to produce liquid nitrogen per ton of LNG refrigerant beyond the prior art constraints of the ratio 0.45.

BRIEF SUMMARY OF THE INVENTION

The present invention is to a cryogenic process for the production of liquefied air components starting with the intermediate product streams generated in a double column distillation system being fed air, and usually comprising a high pressure column and a low pressure column. In the present process, both the low pressure and the high pressure (if an inlet stream) gaseous feed components to be cold compressed are each cooled to differing temperatures in a comparatively warm, heat exchange step. The precooled inlet streams to the multistage compressor means for each feed stream are at markedly different temperatures. One of the produced high pressure, nitrogen streams is passed (as a side stream) through an expander zone to provide added refrigeration (supplemental to that provided by LNG) at the cold end of the liquefaction system. The energy drawn from the first expander zone is employed to cold compress another high pressure nitrogen stream in the final-stage, cold compressor to the highest pressure to provide the highest pressure condensed air component. Lastly, a second dense fluid expander is used on the condensed, cold highest pressure liquid stream, which then provides a major part of the liquid nitrogen product take-off stream.

Precooling of the feed nitrogen streams in the warm end, cooling zone to different temperatures, for intermediate cold compression, facilitates the fuller use of the refrigeration available in the LNG stream, while reducing the energy then needed in the multi-stage compressors. This process serves to make the cooling curves for the initial heat exchangers less irreversible.

According to the invention, a process for the liquefaction of a nitrogen stream produced by a cryogenic air separation unit having at least one distillation column comprises: (a) compressing the nitrogen stream to a pressure of at least 300 psi in a multi-stage compressor wherein interstage cooling is provided by heat exchange against vaporizing liquefied natural gas; (b) dividing the compressed nitrogen stream into first and second compressed nitrogen substreams; (c) cooling the first compressed nitrogen substream by heat exchange against vaporizing liquefied natural gas and then expanding the cooled first compressed nitrogen substream to produce an expanded nitrogen substream; (d) condensing the second compressed nitrogen substream by heat exchange against vaporizing liquefied natural gas and the expanded nitrogen substream of step (c); (e) reducing the pressure of the condensed, second compressed nitrogen stream, thereby producing a two-phase nitrogen stream; (f) phase separating the two phase nitrogen stream into a liquid nitrogen stream and a nitrogen vapor stream; and (g) warming the nitrogen vapor stream to recover refrigeration.

A variation of the above described process comprises subcooling the condensed, second compressed nitrogen substream of step (d), prior to reducing the pressure in step (e), by heat exchange against the warming nitrogen vapor stream of step (g) and the expanded nitrogen substream of step (c). Concurrently, the process also comprises recycling the warmed nitrogen vapor stream of step (g) to an intermediate stage of the multi-stage compressor of step (a).

In another major process embodiment, the reduction in pressure of step (e) is accomplished by work expanding the condensed, compressed nitrogen stream in a dense fluid expander.

In still another process embodiment, this involves recycling at least a portion of the warmed, expanded nitrogen substream of step (d) to an appropriate intermediate stage of the multi-stage compressor of step (a).

In a preferred variation of the first described embodiment, the temperature of the cooled, first compressed nitrogen substream of step (c) is between −100° F. and −250° F. prior to expansion.

DETAILED DESCRIPTION OF THE INVENTION

Figure 1:
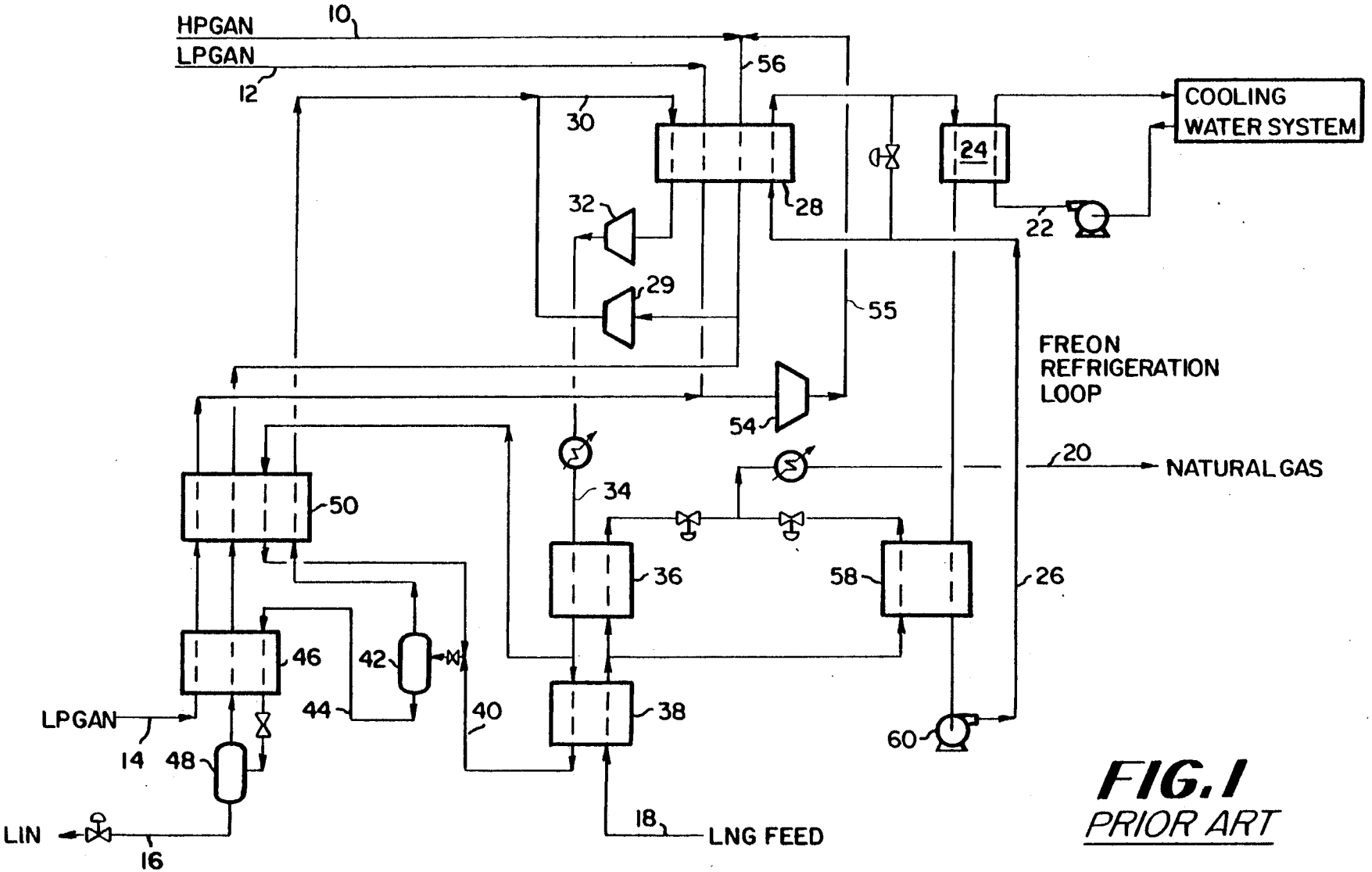
FIG. 1 PRIOR ART
FIG. 1 is a flow diagram of a process that is state-of-the-art for liquefaction of fractionated air components like nitrogen employing recirculating freon as the medium for using the cold energy of refrigerated LNG.

Referring now to the drawing and to FIG. 1, in particular, a state-of-the-art (prior art) nitrogen liquefaction system using recirculating freon as the energy transfer medium between the refrigerant LNG liquid and the gaseous air separation products, like nitrogen, to be liquefied is shown. The inlet feeds, from an air separation unit (not shown), are warm high pressure gaseous nitrogen stream 10, warm low pressure gaseous nitrogen stream 12 and cold low pressure gaseous nitrogen stream 14. The sole product stream from the process is liquid nitrogen stream 16. The system is intended to recover substantially all of the refrigeration available from vaporizing LNG feed stream 18, which exits the process as pressurized natural gas stream 20, now suited to pipeline transport. The only other refrigeration input is from cooling water stream 22, which is heat exchanged in ancillary space heat exchanger 24 which is disposed in closed system 26 for the recirculating freon. The amount of LNG available is deemed enough refrigeration to cool the inlet gaseous nitrogen stream to the cold range of about −180° F. to −260° F. (normal B.P. of nitrogen is −320.5° F.) and produces the required quantity of liquid nitrogen product as stream 16.

Nitrogen feed streams 10, 12 and 14 to be compressed in cold compressors 32, 29 and 54 are typically cooled to the same temperature range in the warm end, heat exchangers located downstream of the first and second stage feed gas compressor.

Nitrogen stream 10 passes through primary heat exchanger 28 for precooling before entering primary cold compressor 29. Compressed gas recycle stream 30 passes through primary exchanger 28 before entering second-stage cold compressor 32. Cooled compressed stream 34 then is further cooled in exchangers 36 and 38, thus forming the primary source of liquid nitrogen product. Cooled stream 40 passes through phase separator 42 with its liquid underflow stream 44 passing through heat exchanger 46, partially warming inlet stream 14 therein, then through another phase separator 48, and exiting as liquid nitrogen product stream 16.

The overhead nitrogen vapors from separators 42 and 48 are recycled through heat exchangers 50 and 46, respectively, before recycling to cold compressors 32 and 29, respectively, wherein they undergo cold compression and then condensation in the heat exchangers.

Inlet stream 12 also is precooled in exchanger 28 before being cold compressed in first stage compressor 54, then being recycled to join other inlet stream 10, with combined streams 56, being again cooled in exchanger 28 before their cold compression in primary cold compressor 29, and the subsequent cooling treatment described earlier for major inlet nitrogen stream 10. Inlet stream 14 is partially warmed in exchangers 46 and 50 and combined with inlet stream 12.

Closed-loop fluorocarbon refrigeration circuit 26 provides refrigeration to main heat exchanger 28 and side heat exchanger 24, located in cooling water loop 22. Primary refrigerant LNG stream 18 is vaporized in downstream exchangers 38 and 36 against cooling, condensing nitrogen and in exchanger 58 against the fluorocarbon in refrigeration circuit 26 and exits the process as product, via stream 20.

Fluorocarbons have long been used as a recirculating fluid to avoid bringing low pressure gaseous nitrogen streams next to LNG in heat exchangers. Otherwise, if a leak were to occur, hydrocarbons would contaminate liquid nitrogen leaving the downstream separators. Utilization of fluorocarbons, however, involves additional energy losses due heat exchangers and pump power requirements; note exchanger 58 and booster pump 60. Use of fluorocarbons also has burgeoning environmental implications, while the use of alternate circulating fluids means an added operating cost.

The process of the present invention will now be described in detail with respect to liquefaction of nitrogen obtained from an air separation unit. The air separation unit used for this purpose is a conventional double column air distillation process. The details of such a process can be found in a paper by R. E. Latimer, "Distillation of Air", *Chemical Engineering Progress*, pp 35–39, February, 1967. However, the process to be described is applicable to any distillation column configuration.

Figure 2:
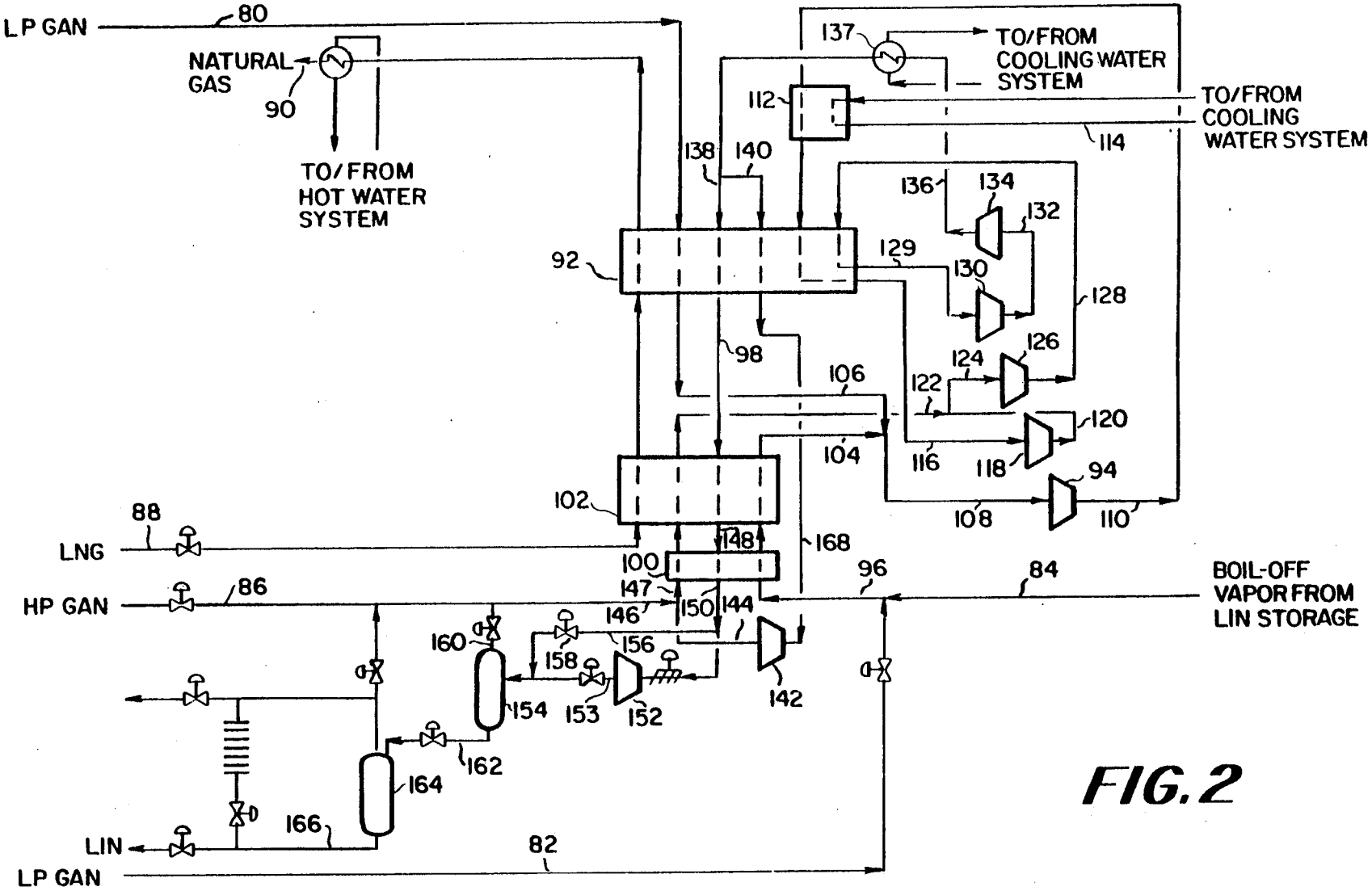
FIG. 2 is a flow diagram of a first embodiment of the present invention for liquefying air components and omitting a common recirculating liquid making use of an LNG refrigerant and also of multi-staged cold compression and reflecting the stream inlet and outlet temperatures about the plural cold compressors and expander.

FIG. 2 depicts the process of the present invention in its simplest embodiment. In this embodiment, nitrogen to be liquefied is supplied from the air separation unit (not shown) as high pressure and low pressure streams. The high pressure nitrogen stream comes from the high pressure column at a pressure greater than 75 psia, and the low pressure nitrogen is obtained from the lower pressure column at a pressure greater than or close to ambient pressure. These streams are supplied as warm (close to ambient temperature) and cold streams to the liquefier system. This mixed supply balances the cooling curves in the heat exchangers (not shown) used in the air separation unit to cool the feed air stream thereto.

Low pressure nitrogen stream 80 is supplied at close to ambient temperature. Stream 82 brings in low pressure nitrogen at a temperature between −150° F. to 300° F. Optionally, boil-off vapor from a liquid nitrogen storage tank (not shown) is fed for liquefaction as stream 84. High pressure nitrogen is supplied from the high pressure distillation column (not shown) as stream 86 at a temperature close to the high pressure distillation column temperature. LNG to be vaporized is provided through line 88. Although LNG is suitable for use as a refrigerant at any pressure, typically, the pressure will be between 100 psi to 1200 psi, such that the vaporized LNG can be sent as stream 90 to the pipeline distribution system without any further compression.

Low pressure nitrogen stream 80 is first cooled with LNG in heat exchanger 92 and then fed to compressor 94. Cold, low pressure nitrogen inlet streams 82 and 84 are combined as stream 96 and used to condense and subcool highest pressure nitrogen split stream 98 in heat exchangers 100 and 102. Resulting slightly warmed, combined feed stream 104 is mixed with cooled low pressure nitrogen stream 106 into combined stream 108. Combined stream 108 is compressed in cold compressor 94 to a pressure such that temperature of boosted nitrogen stream 110 is colder than the ambient temperature. Typically, this temperature is in the range of −100° F. to ambient temperature.

Boosted nitrogen stream 110 is slightly warmed in heat exchanger 112 against chilled water (line 114), and then cooled by heat exchange against vaporizing LNG in heat exchanger 92 to produce cold stream 116 which is fed to second-stage compressor 118. The exhaust of this compressor is high pressure nitrogen stream 120, which is at a pressure similar to that of the high pressure distillation column pressure of the air separation unit; typically, this pressure is in the range of 75 psia to 200 psia. High pressure nitrogen stream 120 is admixed with a cold high pressure nitrogen 122 to produce combined high pressure nitrogen stream 124.

Combined high pressure nitrogen stream 124 is then cold compressed in third-stage compressor 126 to obtain nitrogen stream 128, which is partially cooled in the main heat exchanger 92, and fed as stream 129 to the fourth-stage compressor 130 thereby producing elevated pressure nitrogen stream 132. Nitrogen stream 132 is then compressed in fifth-stage compressor 134 to provide highest pressure nitrogen stream 136. The pressure of stream 136 is in the range of 350 to 1500 psi, and, typically, in the range of 600 to 1220 psi.

Due to LNG precooling being effectuated in exchanger 92, the inlet stream temperature to all the four compressors (with the possible exception of last-stage compressor 134) will be below ambient temperature. Typically, the temperature will be in the range of −50° F. to −260° F., and more likely from −90° F. to −220° F. It is worthwhile to note that the inlet streams to cold compressors 94, 118, and 130 are taken out of heat exchanger 92 at different locations. Cooling of the nitrogen streams to different temperatures in warm heat exchanger 92 for cold compression aids in the proper utilization of refrigeration available in the LNG stream while minimizing the energy used in these compressors.

Highest pressure nitrogen stream 136 is cooled with cooling water in exchanger 137, and divided into two highest pressure nitrogen substreams 138 and 140. First highest pressure nitrogen substream 140 is cooled in heat exchanger 92, and then expanded isentropically in expander 142 thereby producing stream 144. The pressure of stream 144 is now similar to the inlet pressure of high pressure nitrogen stream inlet 86. Augmented inlet stream 146 is combined with stream 144 and the combined stream, line 147, is used in heat exchangers 100 and 102 to cool the other highest pressure nitrogen stream 98. Expander 142 for stream 168 can be loaded with an electric power generator. In the preferred mode, expander 142 is coupled to final-stage compressor 134, and the energy derived from this expander 142 is used to compress elevated pressure nitrogen stream 132 in compressor 134.

Highest pressure nitrogen substream 138 is cooled in heat exchangers 92, 102 and 100 against vaporizing LNG and returning cold gaseous nitrogen streams, i.e., streams 147 and 96 from heat exchanger 100, thereby producing stream 148, which is further subcooled in the heat exchanger 100 to obtain cold, highest pressure nitrogen stream 150. The pressure of stream 150 is reduced to a pressure of about 75 psi to 200 psi by feeding it to a dense fluid expander 152. This isentropic expansion of stream 150 makes the process more efficient. Exhaust stream 153 can be further reduced in pressure and fed to separator 154. Alternately, cold highest pressure nitrogen stream 150 can bypass the dense fluid expander, via stream 156, and reduced in pressure across isenthalpic valve 158. Either way, the reduced pressure cold stream is fed to phase separator 154. The operating pressure of separator 154 is similar to the pressure of high pressure inlet gaseous nitrogen stream 86 (i.e., 75 psi to 200 psi). Vapor stream 160 from separator 154 is mixed with the rest of cold pressure nitrogen stream 86 and sent to heat exchanger 100 as stream 146 for further processing. Liquid nitrogen underflow stream 162 from separator 154 is reduced in pressure and fed to phase separator 164. Liquid nitrogen underflow stream 166 from separator 164 is sent to the air separation unit (not shown) for further handling and production of liquid products. In the air separation unit, other liquid products, such as liquid oxygen and liquid argon can be easily produced by using the refrigeration from the liquid nitrogen supplied, via line 166 of the liquefier.

EXAMPLE

Computer simulations of the process were carried out to determine the functional relationship between the amount of liquid nitrogen produced and the amount of LNG available. The calculated results are summarized in Table I below for the case when the ratio of liquid nitrogen produced to liquid oxygen produced from the air separation unit is three.

TABLE I

| Tons-Liquid Nitrogen per ton-LNG | KWH/Ton-Liquid Nitrogen |
|---|---|
| 0.48 | 207 |
| 0.56 | 248 |
| 0.67 | 264 |
| No LNG | 470 |

The last entry in Table I is for an all electric powered liquefaction plant, i.e., no LNG is used for refrigeration. The power consumptions listed include the power consumed by the air separation unit to produce the gaseous nitrogen and oxygen feed streams.

Table II shows the inlet/outlet temperatures to the various compressors from one of the computer simulations if the process depicted in FIG. 2.

TABLE II

| | °F. |
|---|---|
| First Stage, Inlet Stream 108 | −190 |
| First Stage, Outlet Stream 110 | −75 |
| Second Stage, Inlet Stream 116 | −146 |
| Second Stage, Outlet Stream 120 | −23 |
| Third Stage, Inlet Stream 124 | −111 |
| Third Stage, Outlet Stream 128 | 51 |
| Fourth Stage, Inlet Stream 129 | −95 |
| Fourth Stage, Outlet Stream 132 | 47 |
| Fifth Stage, Outlet Stream 136 | 84 |
| Internal Cold Nitrogen Stream 168 to Expander 142: | −174 |
| Expander 142, Outlet Stream 144 | −284 |

It is readily observed that the inlet temperatures of each of the five compressors are different from each other. These temperature differences aid in the proper utilization of the refrigeration available in the LNG stream, while minimizing the electric energy used in operating these compressors. Also, the cooling curves in the heat exchanger 92 are less irreversible. Note in Table II, that the main inlet to final-stage cold compressor 134 has not been cooled against LNG but is direct flow from compressor 130. Also, the inlet temperature of intermediate compressed stream 168 to cold expander 142 is chosen at an appropriate level.

Although FIG. 2 depicts the preferred embodiment of the present invention, there are some inefficiencies. One such is the mixture of exhaust stream 120 of cold compressor 118, which is at −23° F., with cold stream 122, which is at −195° F., to provide inlet stream 124 to cold compressor 126, which is at −111° F. This inefficiency can be easily remedied by further heating the recycle stream 122 in heat exchanger 92 to an appropriate temperature level (not shown), prior to mixing with compressed stream 120. At the same time, stream 120 would have to be cooled in heat exchanger 92 to the same appropriate temperature level. The two streams will then have to be mixed to provide inlet stream 124 for third-stage cold compressor 126. These steps will make the inlet streams to some of the cold compressors even colder and, thus, reduce energy consumption.

Figure 3:
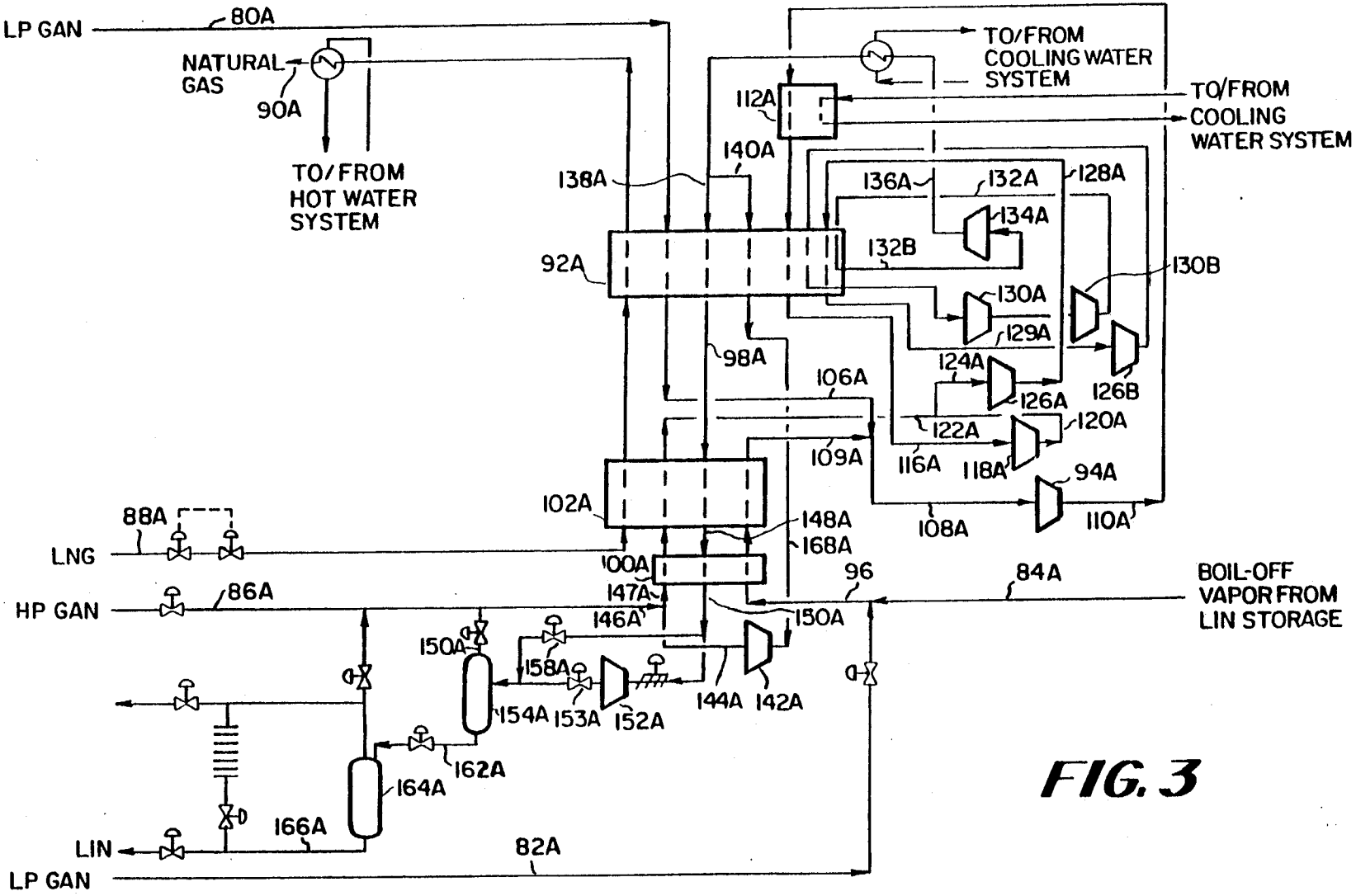
FIG. 3 shows a second embodiment of the invention for liquefying an air component.

FIG. 3 shows another embodiment of the process of FIG. 2. In this embodiment, intermediate-stage compressor 126A uses interstage cooling of stream 128A in exchanger 92A, before passing stream 129A back to cold compressor 126B, and inlet stream 132B which is fed to final-stage compressor 134A is cooled to an appropriate temperature.

Recycle stream 132A undergoes two-stage cold compression and is precooled in exchanger 92A, before introduction as stream 132B into final stage cold compressor 134A. Somewhat similarly, compressed stream 128A from compressor 126A is recooled in exchanger 92A and forms stream 129A which is compressed in compressor 126B.

Figure 4:
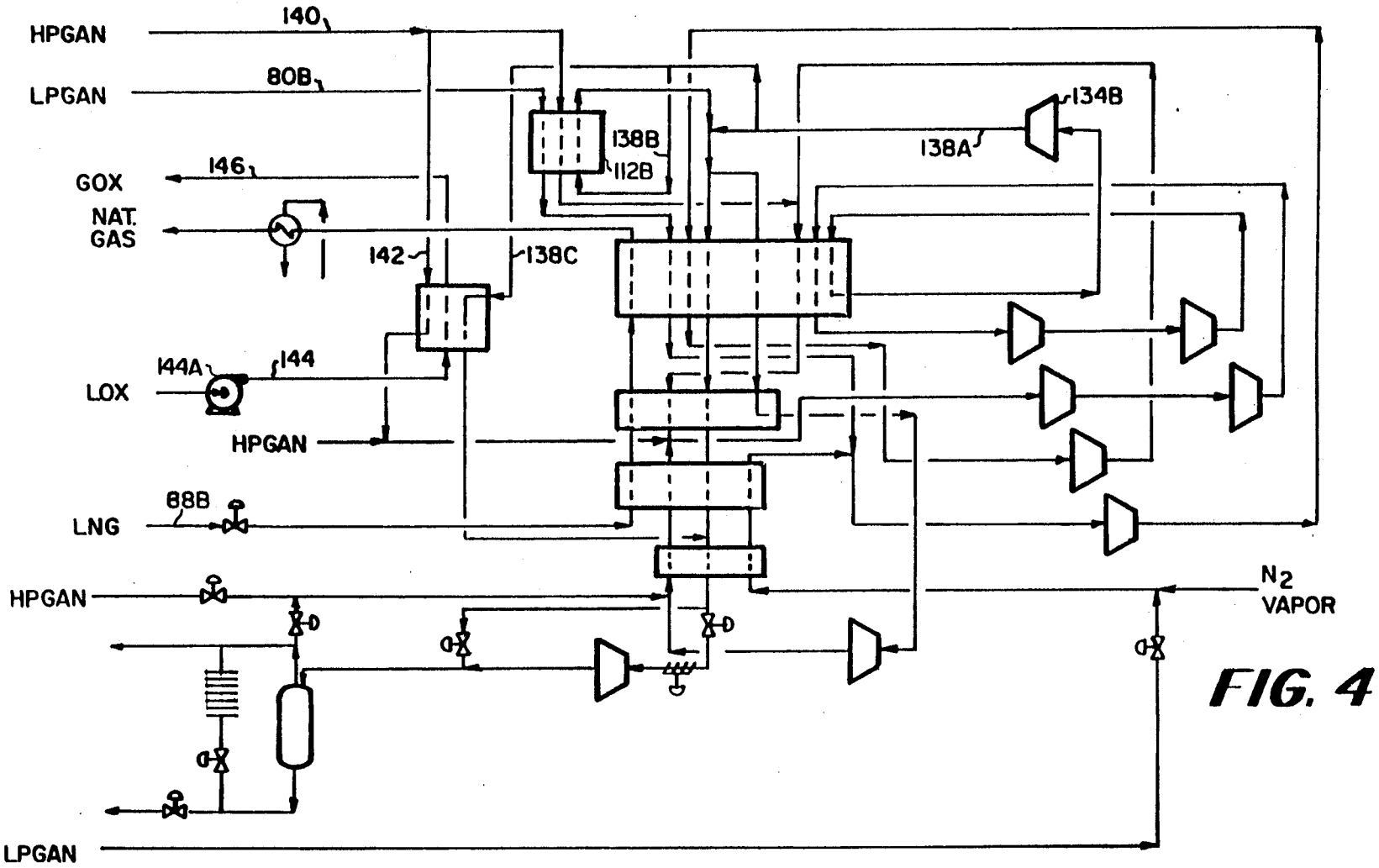
FIG. 4 shows a third embodiment of the present invention for liquefying an air component including precooling of the warm feed streams in an exchanger with a portion of the highest pressure air component product of the process.

FIG. 4 depicts still another process embodiment of FIG. 2. In this embodiment, warm end gaseous nitrogen inlet streams 80B and 140 are precooled in exchanger 112B, against portion 138B of highest pressure nitrogen stream 138A drawn from final stage cold compressor 134B. Small portion 138C of highest pressure nitrogen 138A, along with a portion of medium pressure nitrogen feed stream 142, are used to warm and vaporize oxygen stream 144, which has been increased in pressure by pump 144A to pipeline pressure. The warmed oxygen exits as stream 146. Otherwise, the process configuration is functionally equivalent to the specific embodiment process of FIG. 3, regarding multi-stage stream compression linked with interstage cooling. The embodiment of FIG. 4 allows the integration of nitrogen compression with a pumped liquid oxygen system, such that a portion of compressed nitrogen stream recovers refrigeration from a pumped liquid oxygen stream to deliver gaseous oxygen product at an elevated pressure. This embodiment saves the cost associated with an oxygen compressor.

For the processes of both FIGS. 2 and 3, the lowest pressure nitrogen stream is cooled to the lowest temperature for the first cold compression (i.e., inlet stream 108 to compressor 94). As the stream pressure and its flowrate are increased, the temperatures of the cold compression steps are increased successively. However, it is important to note that this may not always be true. Depending on the quantity of LNG refrigeration available, the cold compressors, such as 126 and 130, could have colder inlet temperatures than compressions 94 and 118, which is contrary to Table II. The primary objective is to match the cooling curves in warm-end heat exchanger 92, as well as possible. To achieve this, various combinations of the inlet temperatures to the cold compressors must be attempted, which models are within the skill of the art, so to result in the most optimum inlet temperature balancing; namely, one giving the lowest energy consumption or to provide maximum utilization of the refrigeration available from the LNG.

LNG is typically composed of more than one component and they each vaporize at different temperatures. This leads to fairly high heat capacities of the vaporizing natural gas over a wide range of temperatures. On the other hand, the heat capacity of the cooling nitrogen streams is a strong function of temperature and pressure. For temperatures in the range of ambient down to −200° F., heat capacity of a nitrogen stream at pressures below 100 psia is about 7 BTU/lb mole °F. Whereas, a nitrogen stream at 800 psia has a heat capacity of about 7.6 BTU/lb mole °F. at 75° F., 9.0 BTU/lb mole °F. at −100° F., 11 BTU/lb mole °F. at −150° F., and about 24.0 BTU/lb mole °F. at −200° F.

The LNG stream (91.4% $CH_4$, 5.2% $C_2H_6$ and 3.4% $C_2^+$) at 725 psia has approximate heat capacities of 14 BTU/lb mole °F., in the temperature range of −160° F. to −240° F.; 19.6 BTU/lb mole °F. at −120° F., 25.6 BTU/lb mole at −100° F., 21.5 BTU/lb mole °F. at −50° F., and 11.5 BTU/lb mole above 0° F. Thus, the amount of LNG used to cool the highest pressure, (say 750 psia), nitrogen stream 98 in the cold heat exchanger 102 to (−180° F. to −250° F. temperature range) will have more refrigeration to cool streams other than this highest pressure nitrogen stream 98 at warmer temperatures in heat exchanger 92.

Because at temperatures lower than −180° F., highest pressure nitrogen stream 98 has a heat capacity either comparable to or higher than LNG. At temperatures higher than −150° F., its capacity is much less than LNG. Between ambient to −150° F., the heat capacity of the highest pressure nitrogen is less than half of the vaporizing LNG. It implies that for efficient recovery of all the refrigeration energy between ambient and −180° F., stored in LNG, some other streams besides the highest pressure nitrogen stream 98 must be cooled.

The present process effectively utilizes the refrigeration available at above −180° F., by cooling lower pressure nitrogen streams, along with the highest pressure nitrogen stream, in heat exchanger 92. Lower pressure inlet nitrogen streams 80, 110 and 128 are cooled and compressed. The compression energy heats the internal nitrogen stream 110, which is again cooled by LNG in heat exchanger 92. Because of recooling of compressed nitrogen after each compression, the enthalpy of LNG from warm heat exchanger 92 is considerably higher. This more fully utilizes the cold energy stored in LNG.

In the disclosed process, after efficient utilization of the LNG refrigeration in warm heat exchanger 92 (ambient down to −190° F. temperature range), the refrigeration in downstream cold heat exchanger 102 is supplemented by expansion of cooled high pressure nitrogen stream 168 in expander 142. This most effectively transfers some of the refrigeration of LNG in the temperature range of ambient to −190° F. to lower temperatures. This also aids in the condensation of larger quantities of nitrogen.

As stated earlier, in order to condense nitrogen at temperatures in the range of −200° F. to 260° F., it must be compressed to a considerably higher pressure. In the present process, nitrogen is precooled prior to each compression stage. This substantially reduces the energy consumption of the liquefaction process. Thus, the process of the current invention effectively utilizes cold energy stored in LNG and produces liquid nitrogen product with low energy consumption.

The present invention has been described with reference to some specific embodiments thereof. These embodiments should not be considered a limitation of the scope of the present invention. The scope of the following invention is ascertained by the following claims.

We claim:

1. A process for the liquefaction of a nitrogen stream produced by a cryogenic air separation unit having at least one distillation column comprising:

(a) compressing the nitrogen stream to a pressure of at least 300 psi in a multi-stage compressor wherein interstage cooling is provided by heat exchange against vaporizing liquefied natural gas;

(b) dividing the compressed nitrogen stream into first and second compressed nitrogen substreams;

(c) cooling the first compressed nitrogen substream by heat exchange against vaporizing liquefied natural gas and then work expanding the cooled first compressed nitrogen substream to produce an expanded nitrogen substream;

(d) condensing the second compressed nitrogen substream by heat exchange against vaporizing liquefied natural gas and the expanded nitrogen substream of step (c);

(e) reducing the pressure of the condensed, second compressed nitrogen stream thereby producing a two phase nitrogen stream;

(f) phase separating the two phase nitrogen stream into a liquid nitrogen stream and a nitrogen vapor stream; and (g) warming the nitrogen vapor stream to recover refrigeration.

2. The process of claim 1 which further comprises subcooling the condensed, second compressed nitrogen substream of step (d) prior to reducing the pressure in step (e) by heat exchange against the warming nitrogen vapor stream of step (g) and the expanded nitrogen substream of step (c).

3. The process of claim 1 which further comprises recycling the warmed nitrogen vapor stream of step (g) to an intermediate stage of the multi-stage compressor of step (a).

4. The process of claim 1 wherein the reduction in pressure of step (e) is accomplished by work expanding the condensed, compressed nitrogen stream in a dense fluid expander.

5. The process of claim 1 which further comprises recycling at least a portion of the warmed, expanded nitrogen substream of step (d) to an appropriate intermediate stage of the multi-stage compressor of step (a).

6. The process of claim 1 wherein the temperature of the cooled, first compressed nitrogen substream of step (c) is between −100° F. and −250° F. prior to expansion.

7. The process of claim 1 wherein a portion of the compressed nitrogen stream of step (a) is cooled and condensed by heat exchange against a pumped liquid oxygen stream thereby producing a pressurized oxygen product stream and a condensed nitrogen stream which is combined with the condensed second compressed nitrogen substream of step (d).

* * * * *